US005930330A

United States Patent [19]

Wolfe et al.

[11] Patent Number: 5,930,330

[45] Date of Patent: Jul. 27, 1999

[54] METHOD AND APPARATUS FOR MULTITAXIS SCANNING SYSTEM

[75] Inventors: David M. Wolfe; William J. Chesnut; James K. Economides, all of Albuquerque, N.M.

[73] Assignee: New Mexico Biophysics, Albuquerque, N.M.

[21] Appl. No.: 08/950,940

[22] Filed: Oct. 15, 1997

Related U.S. Application Data

[63] Continuation of application No. 08/936,035, Sep. 29, 1995, abandoned.

[51] Int. Cl.[6] ..... H05G 1/64

[52] U.S. Cl. ..... 378/98.2; 378/37; 378/98.6

[58] Field of Search ..... 378/10, 4, 12, 378/19, 98.2, 51, 37, 62, 86, 87, 88, 98.6

[56] References Cited

U.S. PATENT DOCUMENTS

| | | | |
|---|---|---|---|
| Re. 33,634 | 7/1991 | Yanaki . | |
| 2,911,539 | 11/1959 | Tanenbaum . | |
| 3,529,161 | 9/1970 | Oosthoek et al. . | |
| 3,691,389 | 9/1972 | Ellis et al. . | |
| 3,778,654 | 12/1973 | Huechen et al. . | |
| 3,949,229 | 4/1976 | Albert . | |
| 4,259,582 | 3/1981 | Albert . | |
| 4,465,540 | 8/1984 | Albert . | |
| 4,718,075 | 1/1988 | Horn . | |
| 4,730,350 | 3/1988 | Albert | 378/10 |
| 4,755,681 | 7/1988 | Oka et al. . | |
| 4,785,186 | 11/1988 | Street et al. . | |
| 4,905,265 | 2/1990 | Cox et al. . | |
| 5,005,195 | 4/1991 | Lanza et al. . | |
| 5,117,114 | 5/1992 | Street et al. . | |
| 5,138,167 | 8/1992 | Barnes . | |
| 5,199,054 | 3/1993 | Adams et al. . | |
| 5,259,012 | 11/1993 | Baker et al. . | |
| 5,267,296 | 11/1993 | Albert . | |
| 5,412,703 | 5/1995 | Goodenough et al. | 378/8 |

FOREIGN PATENT DOCUMENTS

| | | |
|---|---|---|
| 94/19681 | 9/1994 | WIPO . |
| 95/04268 | 2/1995 | WIPO . |

OTHER PUBLICATIONS

Acton, P., "Future potential of charge coupled devices as detectors of ionising radiation", *Nucl. Instruments & Methods in Phy. Res.,* A305:504 (1991).

Alfano, B., et al., "First X–ray images with a double–sided microstrips silicon crystal. A novel detector for digital radiography ?", *Phys. Med. Biol.,* 37(5):1167 (1992).

Ansari, R., et al. "The Silicon Detectors in the UA2 Experiment", *Nucl. Instruments & Methods in Phy. Res.,* A279:388 (1989).

Ansari, R., et al., "Successful Operation of a New Si–Pad Detector with ASIC Readout at the Cern pp–Collider", *Nucl. Instruments & Methods in Phy. Res.,* A288:240 (1990).

Antinori, F., et al., "Results on a 10 Micro Pitch Detector with Individual Strip Readout", *Nucl. Instruments & Methods in Phy. Res.,*A288:82 (1990).

Beker, H., et al., "A hybrid silicon pixel telescope tested in a heavy–ion experiment",*Nucl. Instruments & Methods in Phy. Res.,* A332:188 (1993).

Boret, K., et al., "Electronics and readout of a large silicon detector for LHC", *Nucl. Instruments & Methods in Phy. Res.*A344:185 (1994).

(List continued on next page.)

*Primary Examiner*—David P. Porta
*Attorney, Agent, or Firm*—Fulbright & Jaworski

[57] ABSTRACT

The invention discloses a MultiAxis Scanning System for x-ray imaging in which a reverse geometry source of x-ray (e.g. a raster-scanned electron beam) and a two-dimensional digital detector are used. The system has several advantages, including providing direct digital information, and three-dimensional radiographs with higher resolution and better contrast.

13 Claims, 12 Drawing Sheets

OTHER PUBLICATIONS

Campbell, M., et al., "A 10 MHz Micropowr CMOS Front End for Direct Readout of Pixel Detectors", *Nucl. Instruments & Methods in Phy. Res.,* A290:149 (1990).

Campbell, M., et al., "Development of a pixel readout chip compatible with large are coverage", *Nucl. Instruments & Methods in Phy. Res.,*A342:52 (1994).

Delpierre, P., et al., "Development of silicon microplatter (pixel) detectors", *Nucl. Instruments & Methods in Phy. Res.,*A315:133 (1992).

Heijne, E. J. M., et al., "Development of Silicon Pixel Detectors: An Introduction", *Nucl. Instruments & Methods in Phy. Res.,* A275:467 (1989).

Karchin, P. E., "Section I. Pixel detectors in particle physics. Use of Pixel detectors in elementary particle physics", *Nucl. Instruments & Methods in Phy. Res.,* A305:497 (1991).

Krummenacher, F., et al., "An Experimental no MHz Low Power CMOS Analog Front–End for Pixel Detectors"*Nucl. Instruments & Methods Phy. Res.,* A288:176 (1990).

Munday, D., et al., "A 66 MHx, 32–channel analog memory circuit with data selection for fast silicon detectors", *Nucl. Instruments & Methods in Phy. Res.,* A326:100 (1993).

X–ray microtomography with monochromatic synchrotron radiation (invited), K.L. D'Amico, et al. p. 1524–26.

X–ray computed tomography with 50–um resolution, Seguin, et al., p. 4117–4123.

Top View of Patient's Head

METHOD AND APPARATUS FOR MULTITAXIS SCANNING SYSTEM

This application is a continuation of application Ser. No. 08/536,035, filed Sep. 29, 1995, now abandoned.

TECHNICAL FIELD OF THE INVENTION

This invention relates to radiography. More particularly, it discloses a MultiAxis Scanning System for x-ray imaging in which a reverse geometry source of x-ray (e.g. a raster-scanned electron beam) and a two-dimensional digital detector are used. The system has several advantages, including providing direct digital information, and three-dimensional radiographs with higher resolution and better contrast.

BACKGROUND OF THE INVENTION

The abbreviations in this application for the chemical elements are those used for the Periodic Table.

The use of x-rays to take pictures of the human body is almost 100 years old. The standard x-ray tube (a point source) and film (a spatially distributed detector) are commonly used throughout the medical world. Often, the film, which has a very low sensitivity or efficiency to x-ray photons, is employed together with a fluorescing screen which is placed directly in front of the film. Using this technique, reasonably high efficiencies of x-ray photon absorption can be achieved. The spatial resolution obtainable depends upon the film used; the very best film provides resolutions of the order of 18 line pairs per millimeter, about 50 microns in space. There is no energy resolution possible in the standard system, but this is unimportant since most x-ray sources are very broad in energy.

The human body absorbs most x-ray photons below about 30 keV. Thus, most standard x-ray machines use a tungsten (W) or other heavy metal target and an incident electron beam of 60 or more keV. Radiology is typically conducted at energies up to 90 or so keV.

The use of the point x-ray source and spatially distributed film detector has been adopted for mammographic uses. Soft tissue radiology, such as mammography, uses a much lower energy system. Here a molybdenum (hereinafter referred to as "Mo") target and an electron beam of about 25 keV is used. The amount of tissue to be penetrated is not great, and there is no bone. Small calcifications represent one of the many signs that radiologists seek in their search for possible breast cancers.

Mo emits a spectrum of x-rays up to the maximum energy of the electron beam (~25 keV) but with peaks at about 17 and 19 keV due to its atomic structure. A typical spectrum is shown in FIG. 1 (the Mo spectrum as shown in *Medical Imaging Physics*, 3rd ed., Hend, W. R. & Ritenour, R., p. 131). The Mo target is followed by a very thin foil of Mo (generally about 30 micrometers). This foil emphasizes the two lines produced, at 17 and 19 KeV, by reducing the flat background radiation.

The use of so-called reverse geometry x-rays has also been noted. A reverse geometry distributed source of x-radiation with a point detector has been developed by DigiRay Co., San Ramon, Calif. (which is the assignee of U.S. Pat. Nos. 3,949,229; 4,259,582; 4,465,540; and 5,267,296, all to R. D. Albert). In these systems, a point detector, usually an inorganic crystal such as NaI, is used in conjunction with a scanned x-ray source. The x-ray source consists of an electron beam striking a metal target, but the beam is scanned across the target in a fashion similar to the raster scan of a television tube, i.e. a raster-scanned x-ray beam is produced.

The idea of making a digital radiographic system to replace the presently-used analog film recording has a history of over 20 years. The advantages of digital radiography are numerous and have been discussed at length in the literature. Generally, digital detectors have been used to replace film directly. For many reasons, the replacement of film has never taken hold and digital systems continue to be experimental in nature.

Microstrip detectors (also called "crossed-strip microstrip detector" or "crossed-strip detector") for charged particles for two-dimensional imaging have been in use in high-energy physics experiments for several years to detect ionizing particles. They have been used with charged particles which penetrate the 300 $\mu$m silicon (Si) detector. These detectors can have spatial resolution down to less than 20 $\mu$m. By taking two of these detectors at right angles to one another, it is easily possible to get both x and y knowledge of the particle's position. Two-dimensional detectors {Krummenacher, F. et al., *Nucl. Instruments& Methods Phy. Res.*, A288: 176–179 (1990)} are known in the art and are used to produce two-dimensional readout {see e.g., Campbell, M. et al., *Nuclear Inst. & Methods in Phy. Res.*, A290:149–157 (1990)}. The information from the detector elements can be in the form of analog signals generated by individual particles or photons, or alternatively, it can be the total amount of charge integrated in an element during a time interval. In both cases, the signals could be processed through analog-to-digital conversion or through a discriminator (threshold comparison or 1-bit analog-to-digital converter (ADC)) {Heijne, E. H. M., et al., *Nuclear Inst. & Methods in Phy. Res.*, A275:467–471 (1989)}. The semiconductor detector thus provides a direct link to digital information processing.

B. Alfano et al., produced two-dimensional x-ray images using a point source x-ray generator and a double-sided microstrip silicon (hereinafter referred to as "Si") detector. {Alfano, et al., *Phy. Med. Biol.,* 37(5):1167–1170 (1992).} The measurements were performed with photons emitted from two different sources, namely $^{109}$Cd and $^{241}$Am. Alfano, et al. used a silicon crystal 300 $\mu$m thick, 1.4×1.4 cm$^2$ surface area with microstrips deposited on each side to give two orthogonal coordinates in the plane normal to the incoming photon. The electrodes, 12 $\mu$m wide, were deposited in arrays with 25 $\mu$m spacing on the junction (J) side and with 50 $\mu$m spacing on the ohmic (Ω) side. The read-out pitch was 100 $\mu$um for both sides. A limited number of channels were equipped with standard preamplifier+amplifier "front-end" electronics. The signal of each channel was sent both to an analog-to-digital converter (ADC). Images were obtained by exposing to the 60 keV photons, from the $^{109}$Cd and $^{241}$Am sources, the double-sided microstrip silicon detector with tantalum wires, i.e. high contrast objects as phantoms.

SUMMARY OF THE INVENTION

The invention presents a MultiAxis Scanning System (MASS) which can be used as an x-ray imaging system. Preferably, the system provides digital images, and more preferably, high resolution images. Even more preferably, the system produces three-dimensional images, in particular, high contrast images. Most preferably, the images have higher resolution and better contrast than those from conventional x-ray system.

The term "system" as related to MASS and the term "MASS" as herein defined include the theory of MASS, and the apparatus and method for executing MASS. MASS can be used, e.g. to replace conventional radiography, especially mammography where it reduces radiation exposure and does not require painful compression of a patient's breast.

DETAILED DESCRIPTION OF THE INVENTION

Figure 1:
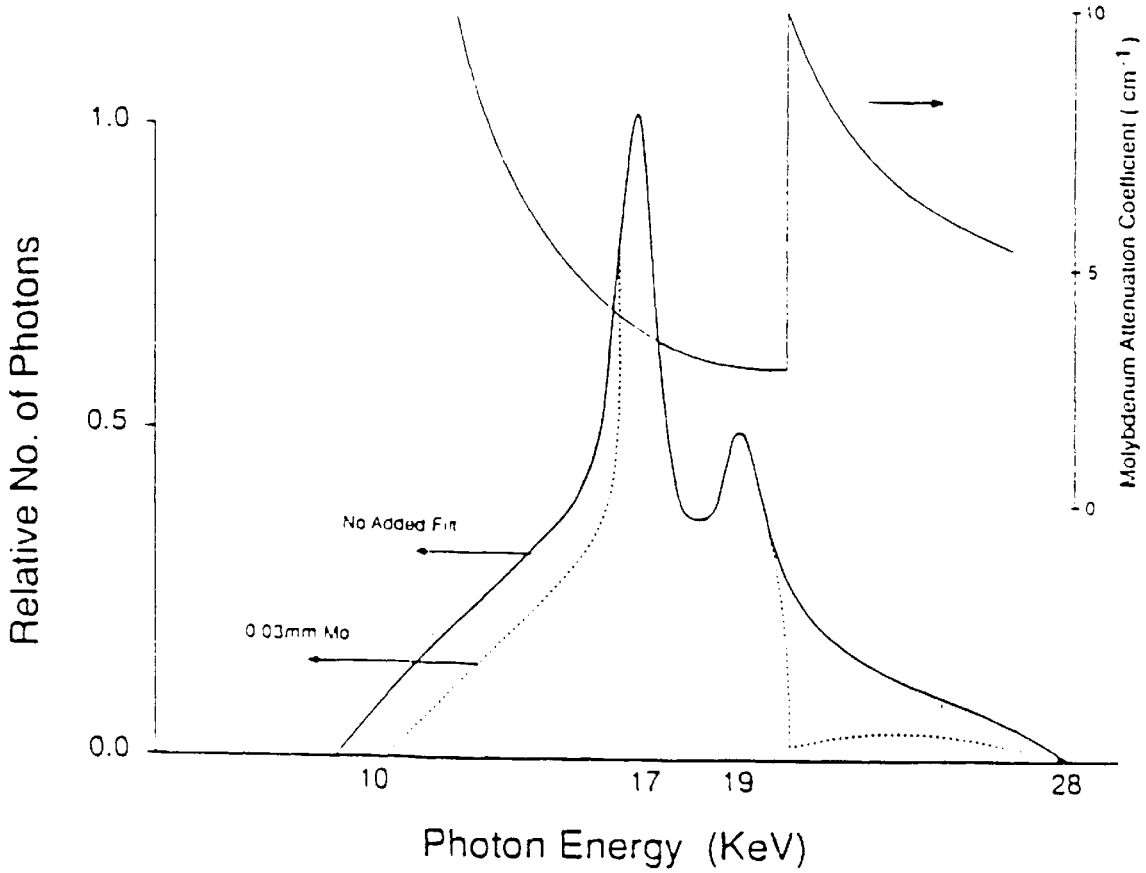
FIG. 1 is a graph presenting a typical spectrum of x-rays emitted by a Mo target when impacted by an electron beam.

The term "MASS" is an abbreviation of the term "MultiAxis Scanning System".

The term "system" as it relates to MASS and the term "MASS" as herein defined include the theory of MASS, the apparatus and method for executing MASS.

The term "two-dimensional detector" is meant to refer to a detector capable of detecting the x- and y- coordinates of radiation impinging on the detector. A two-dimensional detector is typically formed of a two-dimensional array of detecting elements.

The present invention presents MASS which can be used for all radiology, e.g., for any imaging system employing high energy particle or wave for imaging, such as electrons, neutrons, photons (e.g. x-ray), ionizing particles, infrared, gamma-ray, alpha-ray; and ultrasound imaging systems. MASS is based on a reverse geometry source of radiation, e.g. a two-dimensional scanned radiation source, used in conjunction with a two-dimensional detector, e.g. an x-ray raster scanned radiation source with a two-dimensional array of solid-state x-ray detectors. MASS can be used, e.g. to replace conventional radiography, especially mammography where it does not require compression of a patient's breast and reduces radiation exposure. Preferably, the system provides digital images, and more preferably, high resolution images. Even more preferably, the system produces three-dimensional images, in particular, high contrast images. Most preferably, the images have higher resolution and better contrast than those from conventional x-ray system.

For ease of discussion, the discussion herein utilizes x-ray to illustrate the invention. However, the present invention is equally applicable to the other imaging systems described above, given adjustments known in the art directed to the specific idiosyncracies of the other systems. The use of a reverse geometry source of x-ray source in conjunction with one or more two-dimensional detectors, the improvement of the components of the imaging system, preferably together with a system geometry selected to improve image contrast by reduction of intercepted scattered photons, distinguish the present invention from conventional computer-aided tomographic (CAT) or digital radiographic systems. The x-rays are generated by a focused electron beam directed at a high-Z raster screen (e.g., tungsten or Mo film or target). The electron beam coordinates on the raster screen are established by a digitally controlled X-Y deflection system, much in the same way as the pixel coordinate of a computer CRT monitor is controlled.

X-rays are emitted from any designated point on the raster screen. A raster, consisting of a pattern of small focused points, will be "painted" by the electron beam onto the raster screen. The size of the raster screen depends on its application. For mammography, the raster screen is usually made of several 1 inch×1 inch raster screens.

An example of a reverse geometry source of x-rays is a raster-scanned electron beam. The apparatus and methods for producing a raster-scanned electron beam can be those known in the art, such as disclosed in U.S. Pat. Nos. 3,949,229; 4,259,582; 4,465,540; and 5,267,296, all to R. D. Albert. The apparatus are available from DigiRay Corp. These apparatus and methods use a single point detector, generally made of NaI or plastic scintillator.

Instead of a single point detector, the present invention uses a two-dimensional detector together with a reverse geometry source of x-rays. With this combination, the present invention allows a three-dimensional image to be reconstructed. In this invention, the raster scanned radiation is used to scan an object. The radiation penetrates the object but is impeded by materials, usually materials of interest, in the object. The two-dimensional detector detects the radiation to determine the impedance of the radiation by the materials of interest. The impedance may then be processed to produce an image, preferably a three-dimensional image, of the object and any materials which may be present in the object. The impedance can be determined by two methods. The first method resembles a CAT scan or conventional x-ray imaging system, in that the two-dimensional detector detects the radiation that passes through the object. The second method resembles a radar or sonar system, in that the two-dimensional detector detects the radiation that reflects from the object, e.g. in the case of x-ray, the back-scattered x-ray is detected. Thus, the first method may be used in instances where conventional x-ray or CAT scan is used, such as for observing or detecting: foreign objects (e.g., shrapnels, splinters, and glass fragments), cellular components (especially abnormal cellular components or growths such as tumors, cysts, etc.), structures (e.g., dental or cranium defects) or lesions in the body of an animal; contents of containers (e.g., useful for airport luggage security checks); and structures of objects (e.g., structural integrity or defects of products such as planes, machines, and gemstones). MASS provides images that are of higher resolution, in particular, it shows soft tissue with increased details. MASS can thus detect or image areas with unique tissue density which is different from the surrounding or normal tissues. For example, MASS can detect carotid arteries, abdominal lesions, prostate glands, colon tumor, abdominal tissue mass, and cysts, especially small cysts. The foregoing subjects are generally poorly resolved by traditional x-ray. For MASS, in the case of x-ray, this high resolution is achieved partly by using soft x-ray, e.g., by using Mo target as the raster screen. The soft x-ray is preferably between 15 to 30 KeV, preferably used in combination with Si detector of resolution of about 50 $\mu$m.

For example, at best, contemporary x-ray such as mammography provides resolutions of greater than approximately 50 $\mu$m in space. This is done in a flat, two-dimensional picture. The MASS apparatus improves upon the resolution AND simultaneously provides a three-dimensional tomographic image of the object such as breast! The preferred MASS apparatus produces a resolution of between about 25 to about 50 $\mu$m in all three dimensions throughout an imaged object. The present invention is particularly useful for mammography. The second method may be applied in instances where a radar or sonar system is used. For example, MASS may be used to detect land mines.

In its preferred embodiment, MASS produces a complete three-dimensional reconstruction of an object and/or materials within the object, not just a series of slices as provided by tomographic systems of the current art; i.e., MASS produces a computer-generated three-dimensional "sculpture" of an object, whereas a CAT scan generates a slice-by-slice image of the object. Due to its scanning nature, MASS utilizes a much lower radiation dose thereby reducing the risk of radiation exposure for irradiated patients.

Figure 8:
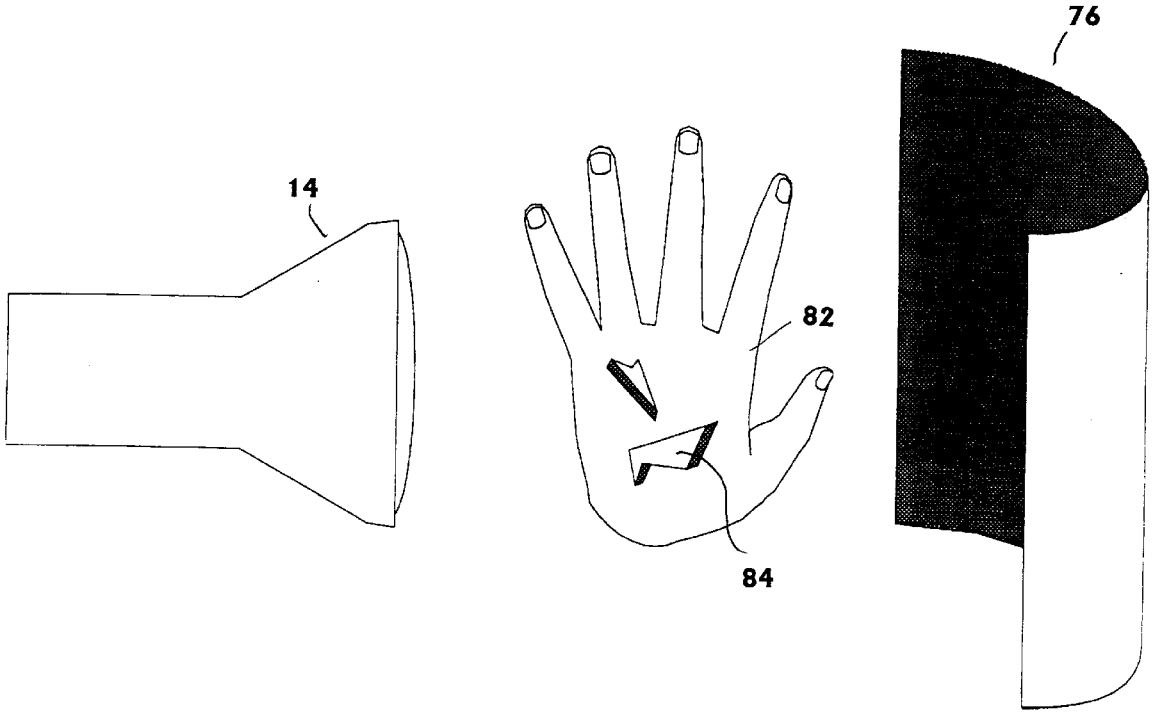
FIG. 8 schematically presents another application of the invention for three-dimensional imaging of a hand for the detection of non-metallic objects, in this case, glass.

MASS also has the advantages of providing higher resolution and better contrast. Moreover, MASS provides direct digital imaging: the radiograph is derived directly from digital information rather than from scanning from a film. The advantages of digital medical images are well known. For example, digital information, stored in a computer, allows the subtraction of pictures taken at different times to be made automatically. Thus, a physician can watch the healing of a fracture, or any other time-dependent change, in an extremely simple fashion. Further, digital information is easily transmitted. The MASS apparatus' small size, portability, relatively low cost, and digital system will enable its widespread use, including in remote locations, and the direct transmission of information. Examinations, such as mammography, can be done at remote locations with the information sent via the Internet or satellite communications to major urban hospitals for detailed analysis by experts. Trained specialists can interpret the data (which can be obtained by a trained x-ray technician) if no physician or expert is available. The same feature also allows its use in emergency vehicles. The emergency vehicle will be able to send pictures to the emergency room in advance of arriving at the hospital. The above factors, and the improved image contrast and spatial resolution of the apparatus makes it an attractive imaging aid for battlefield treatment of shrapnel wounds, both metallic and non-metallic (see e.g. FIG. 8 which schematically presents an example of three-dimensional imaging of a hand 82 for the detection of non-metallic objects, such as glass 84 in this case).

The small size, portable nature, and three-dimensional output of the system also allows its use in the operating theater. Further, standard techniques can be used to apply markers, such as chemical dyes or metals, to highlight or distinguish the desired from the undesired surgical locations, such as lesions, tissues or locations of abnormalities, to allow surgeons to know the precise surgical locations, resulting in less trauma and the removal of lesions or abnormalities too small to be palpated. Adding false coloration to the MASS images will allow the surgeon to have three-dimensional images that look more similar to the actual tissue.

By using a reverse geometry source of x-rays, the present invention extends the life of an x-ray tube, since the electron beams dwells only briefly on any point on the screen thereby minimizing heating and target erosion.

Figure 11:
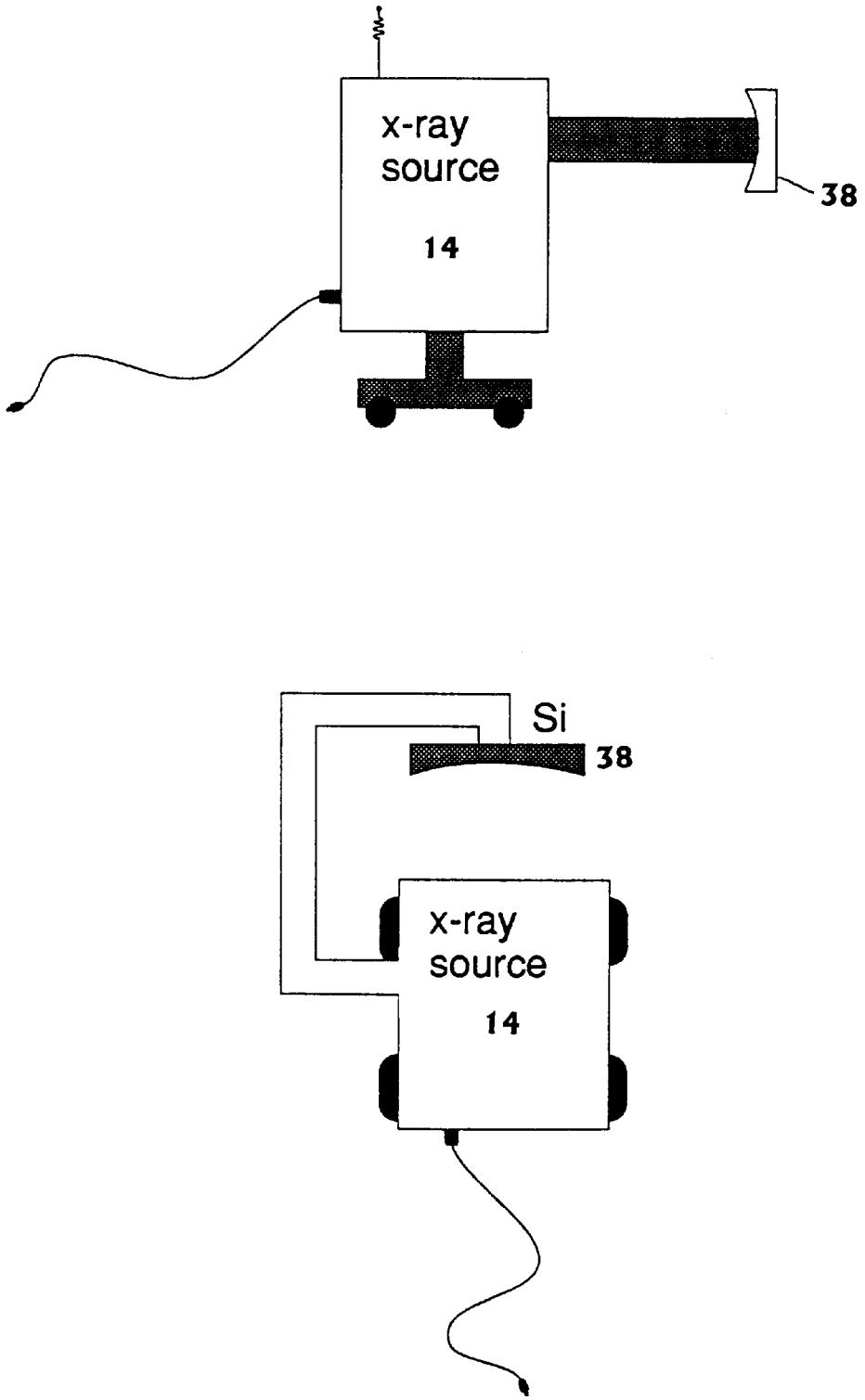
FIG. 11 schematically presents MASS as a portable computer-aided tomographic (CAT) scan.

Besides replacing standard radiography, this system, due to its three-dimensionality, can replace the present CAT scanners. Moreover, due to its comparably cheaper components and easier setup, the MASS units are much less expensive than current CAT scanners, resulting in a lower cost to the health care provider. Portable MASS can be used (see e.g. FIG. 11 for an illustration of portable MASS equipments). FIG. 11 schematically presents MASS as a portable computer-aided tomographic (CAT) scan, the necessary lead shielding is not shown in the figure.

Figure 9:
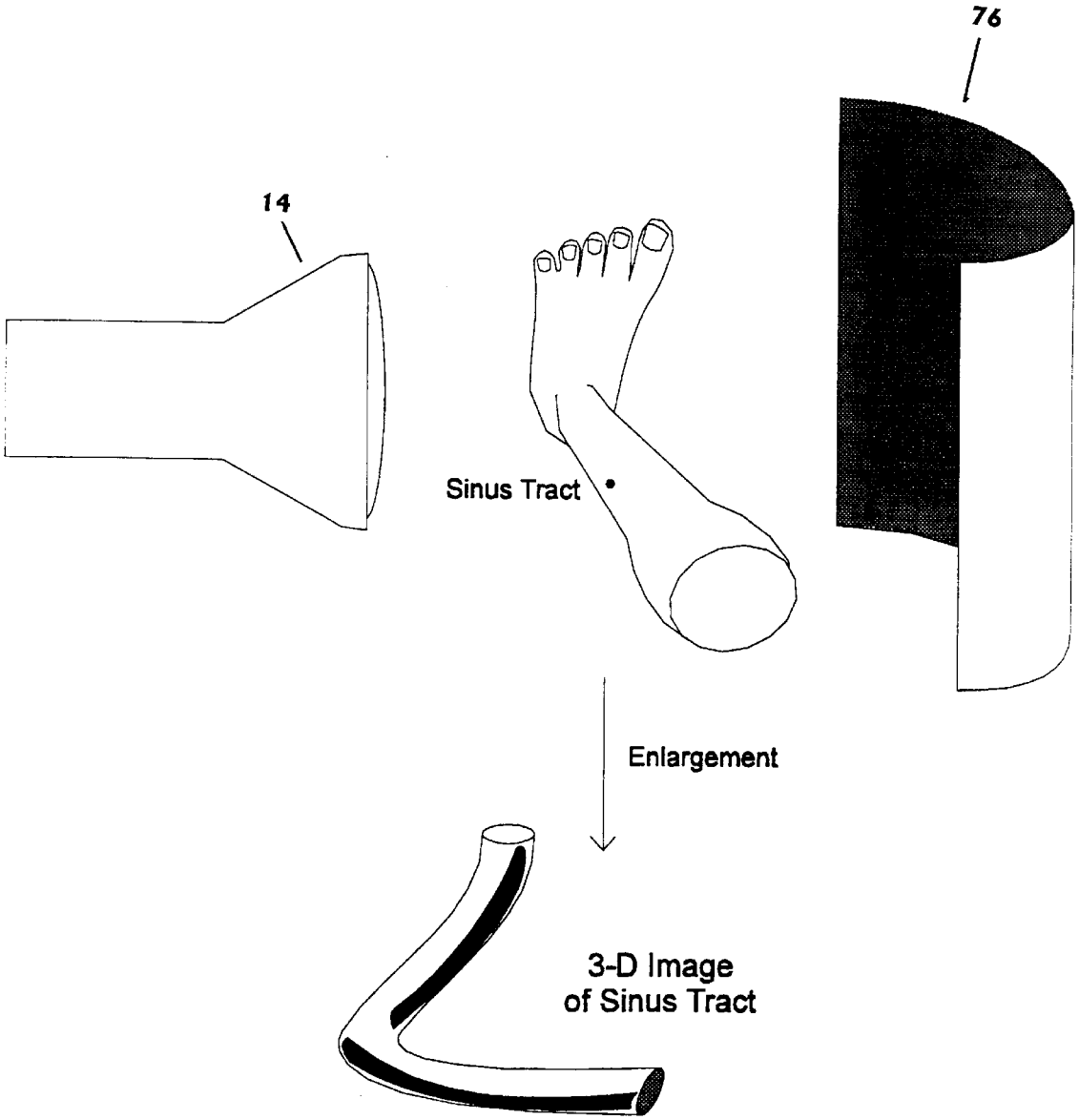
FIG. 9 schematically presents another application of the invention for three-dimensional imaging of sinus tract in a leg, the image can be enlarged as shown at the bottom of the drawing.

MASS also allows for improved image contrast. Image contrast is usually degraded by scattered x-ray photons. Unlike normal radiography, where the film is normally placed close to the object, the raster source permits the detector, such as semiconductor detector array, to be placed at a greater distance. With this geometry, the detector or array intercepts fewer scattered photons. Though it can detect or image both metallic and non-metallic objects, the high contrast of MASS is especially advantageous in allowing for the imaging of low contrast objects such as glass and other non-metallic materials, e.g. embedded in a patient's body parts (see e.g. FIG. 8, described above, for an illustration of its use). It also allows the detection of sinus in tissue which represents a problem for current technology. FIG. 9 schematically presents an example of a soft tissue MASS, used for three-dimensional imaging of sinus tract in a leg, the image can be enlarged as shown at the bottom of the drawing.

Further, MASS provides improved spatial resolution: the image resolution can be better than that of fine-grain film. The resolution is determined by a combination of the detector pixel size, the number of pixels, the step of the x-ray source raster, and the effective magnification, further described below.

Having described the features and advantages of the present invention, the following describes in detail the preferred embodiments of the invention.

MASS

Figure 3:
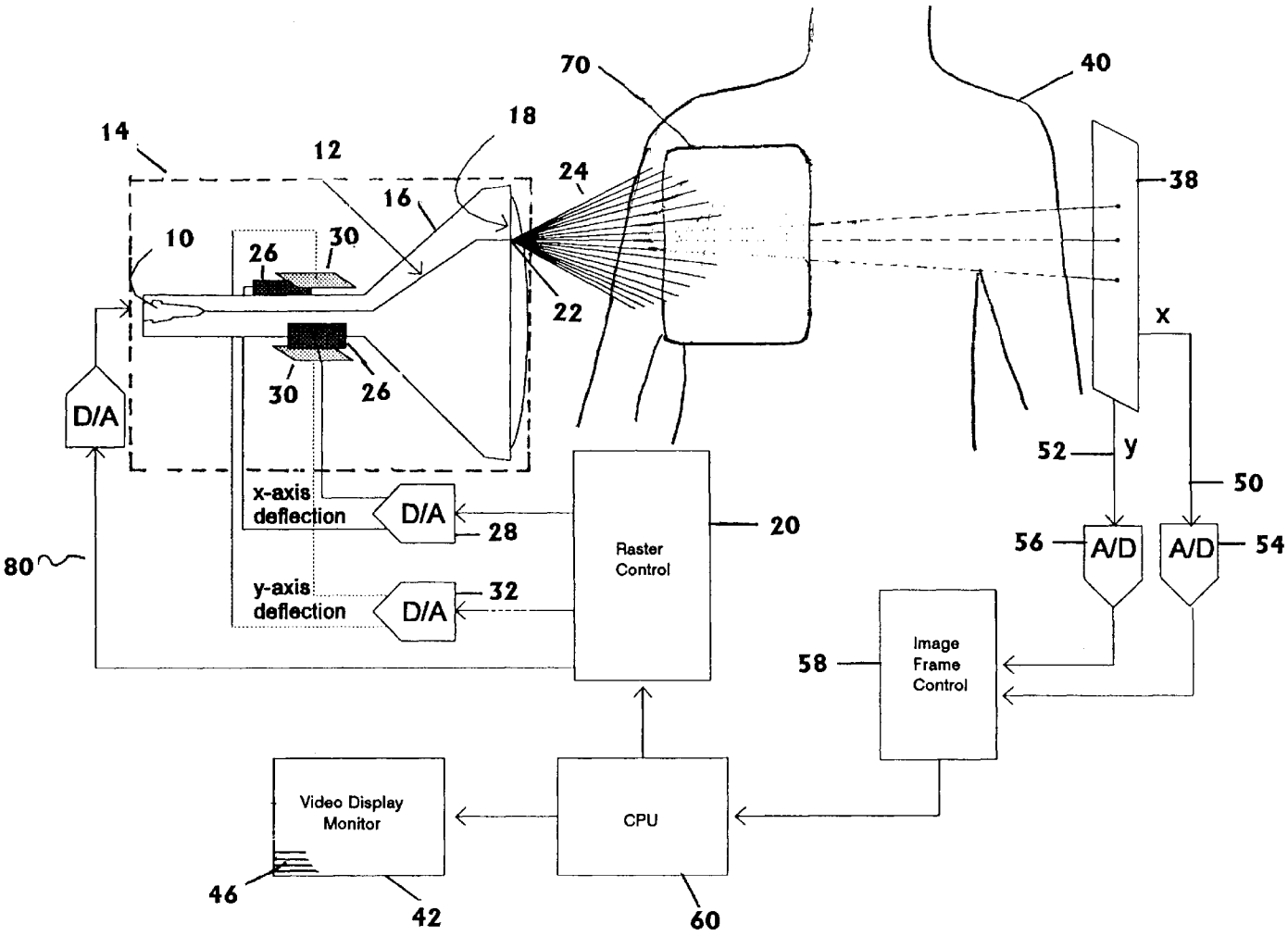
FIG. 3(A) schematically presents an unscaled perspective view of a scanning x-ray source and a two-dimensional x-ray detector and in part, a block diagram showing the major components of the preferred embodiment of the invention.
FIG. 3(B) presents the perspective view of a raster screen.
Figure 3:
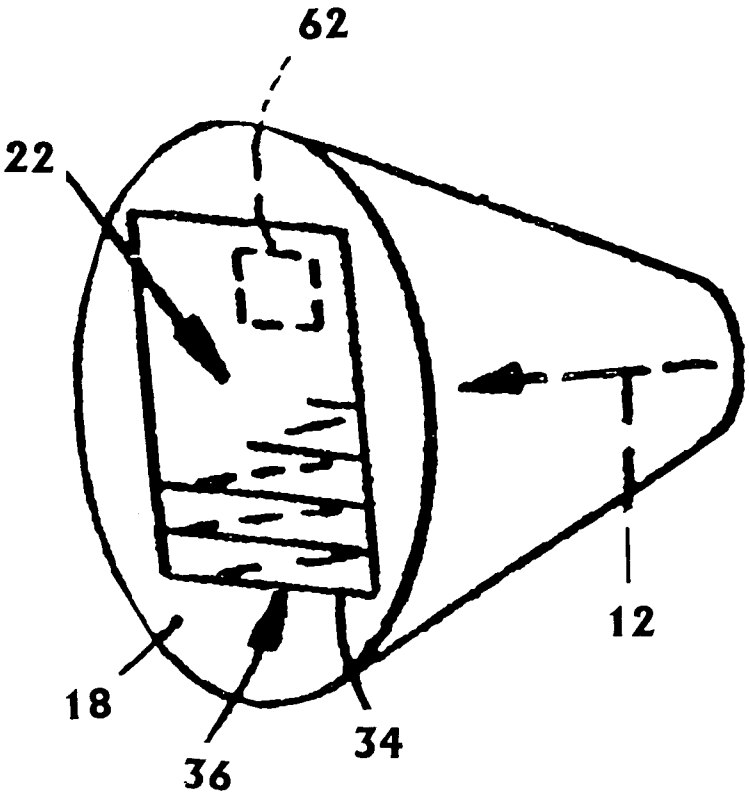

To illustrate the invention, FIG. 3(A) schematically presents a perspective view of a scanning x-ray source and two-dimensional x-ray detector and in part, a block diagram showing the major components of the preferred embodiment of the invention. A buffering system can be included if necessary. In the figure, "D/A" denotes digital-to-analog converter; "A/D" denotes analog-to-digital converter.

Referring to FIG. 3(A), an example of an x-ray imaging system utilizing MASS includes a scanning x-ray source or tube 14 and two-dimensional x-ray detector 38. The scanning x-ray source 14 has an electron gun 10, situated in an evacuated envelope 16, which directs an electron beam 12 towards a raster screen 18 (also commonly referred to as "anode plate"), that forms the front face of the envelope. The raster screen 18 is grounded. An x-ray source raster control 20 contains and controls a tube voltage supply circuit which applies a high negative voltage to the electron gun 10. The voltage difference accelerates electron beam 12 and the impact of the high energy electrons on raster screen 18 results in emission of x-rays at an x-ray origin point 22 situated at the point of impact of the beam on the plate. 24 represents the x-rays emitted from the raster screen 18.

As shown in FIGS. 3(A) and 3(B), the x-ray origin point 22 is swept in a first raster pattern 36 on raster screen 18 by x-axis beam deflection means 26 which receives beam deflection signals from an x-axis sweep frequency generator 28; and y-axis beam deflection means 30 which receives beam deflection signals from a y-axis sweep frequency generator 32. The x- and y-axis beam deflection means 26 and 30 are controlled by x-ray source raster control 20. X-axis sweep frequency generator 28 produces a voltage having a sawtooth waveform that exhibits repetitive rises separated by abrupt drops while y-axis sweep frequency generator 32 produces a similar waveform that rises and drops at a lower frequency. Consequently, x-ray origin point 22 scans raster screen 18 along a series of substantially parallel scan lines 34 that jointly define the first raster pattern 36. FIG. 3(B) presents the perspective view of the raster screen 18 to show the first raster pattern 36, scan line 34, and reduced raster pattern 62. The sweep frequency generators 28 and 32 adjust the output voltages as needed to compensate for pincushion distortion and to accommodate to changes of electron beam energy using method known in the art, such as described in U.S. Pat. No. 5,267,296. For each point in the x-ray tube's x-y raster, the electron beam current is pulsed, generating a brief burst of x-ray photons.

Two-dimensional detector 38 is spaced apart from the x-ray source 14 and the subject 40 which is to be imaged is situated between the source and detector. The detector is preferably a solid state detector with subdivisions of sensitive areas, e.g., pixels. For example, the photons pass through and are attenuated by the object being imaged; they are then detected in the form of a high efficiency image by the detector 38. The digitized value of x-ray intensity for each pixel in the detector array is then either stored or may be processed in real time. The digitized values comprise an image from the perspective of each particular x-ray point emission coordinate. The x-ray source x-y coordinate is then incremented and another x-ray pulse generated and its image detected. This cycle is repeated until the entire x-ray source raster scan is completed. A multitude of x-ray sources are generated as the electron beam is scanned across the face of the tube. Each point emits a much smaller number of x-rays than a regular tube.

For example, in the case of a crossed-strip detector, the detector produces an x-output signal voltage 50 that varies in accordance with variations of x-ray intensity at the sensitive areas. This analog output signal voltage is transmitted to the x-output analog-to-digital converter 54, and is converted to digital output signal voltage. The raster pattern along the y-axis is similarly generated and detected, but along the y-axis. The detector produces a y-output signal voltage 52 that varies in accordance with variations of x-ray intensity at the sensitive areas. This analog output signal voltage is transmitted to the y-output analog-to-digital converter 56, and is converted to digital output signal voltage. The two x- and y- digital output signal voltages are processed by a computer central processing unit (CPU) 60 to produce a visual image which is displayed on the screen of the video display monitor 42 as a projection of a three-dimensional image 46. In the case of a pixel detector, the x- and y- positions of the raster pattern are given by the pixel's position. The pixel detector produces a single output signal voltage which is processed by a computer central processing unit (CPU) 60 to produce a visual image which is displayed on the screen of the video display monitor 42 as a projection of a three-dimensional image 46.

Digital storage of the raster is effectuated at the CPU 60. The CPU 60 can also automatically adjust operating voltages and currents as needed to accommodate to different modes of operation of the system through the x-ray source raster control 20. The image frame control 58 translates the raw analog to digital information, e.g., from x-output ADC 54 and y-output ADC 56, so that it can be efficiently handled by the CPU 60.

As a further refinement, a human operator may also operate the CPU 60 to zoom in or rescan specific regions of a subject, e.g. rescan within a reduced raster pattern 62 (see FIG. 3(B)). Utilizing the stored area of interest raster addresses, the CPU 60 determines and initiates changes in the x and y sweep frequency waveforms that are needed to confine the reduced raster pattern 62 to the portion of the original full sized raster pattern that begins at an address corresponding to the first stored raster address and ends at the address which corresponds to the second stored address. The reduction and relocation of the x-ray tube raster pattern enables production of a magnified, high resolution image at the screen of the video display monitor 42. The production of a magnified, high resolution three-dimensional image at the screen is thus achieved.

A simple PC control system, using a system such as CAMAC (commercially available, e.g., from LeCroy Corp., Chestnut Ridge, N.Y.), may be used to handle the electron beam sweep and focus systems. The readout electronics are only required to count rather than to record complicated information such as energy. If the energy is to be measured, then Fast Analog to Digital Converter (FADC) (commercially available, e.g., from LeCroy Corp.) can be used, this application can be used to improve contrast.

Figure 2:
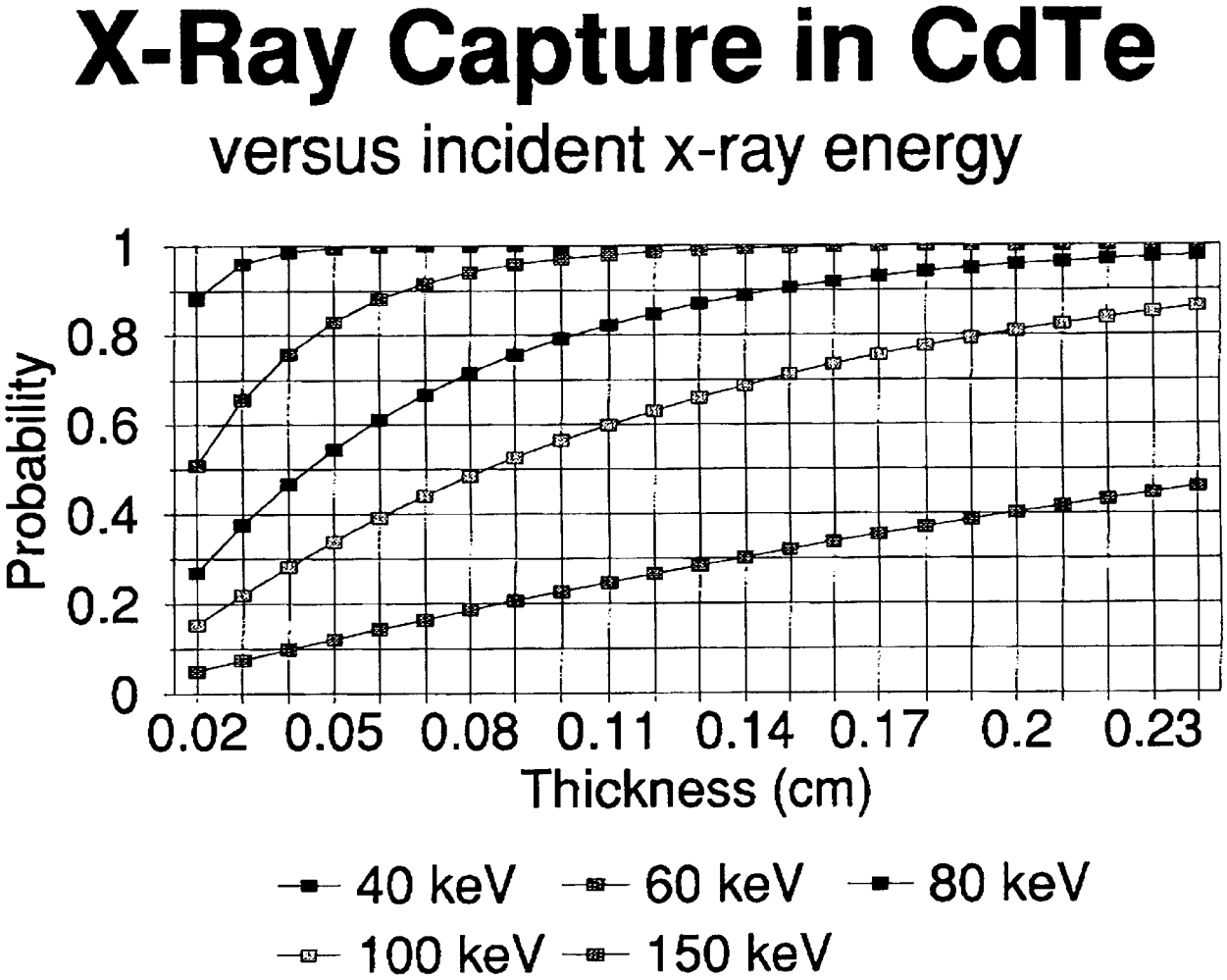
FIG. 2 is a graph showing the x-ray captured in CdTe in relation to the incident x-ray energy and thickness of CdTe.
Figure 6:
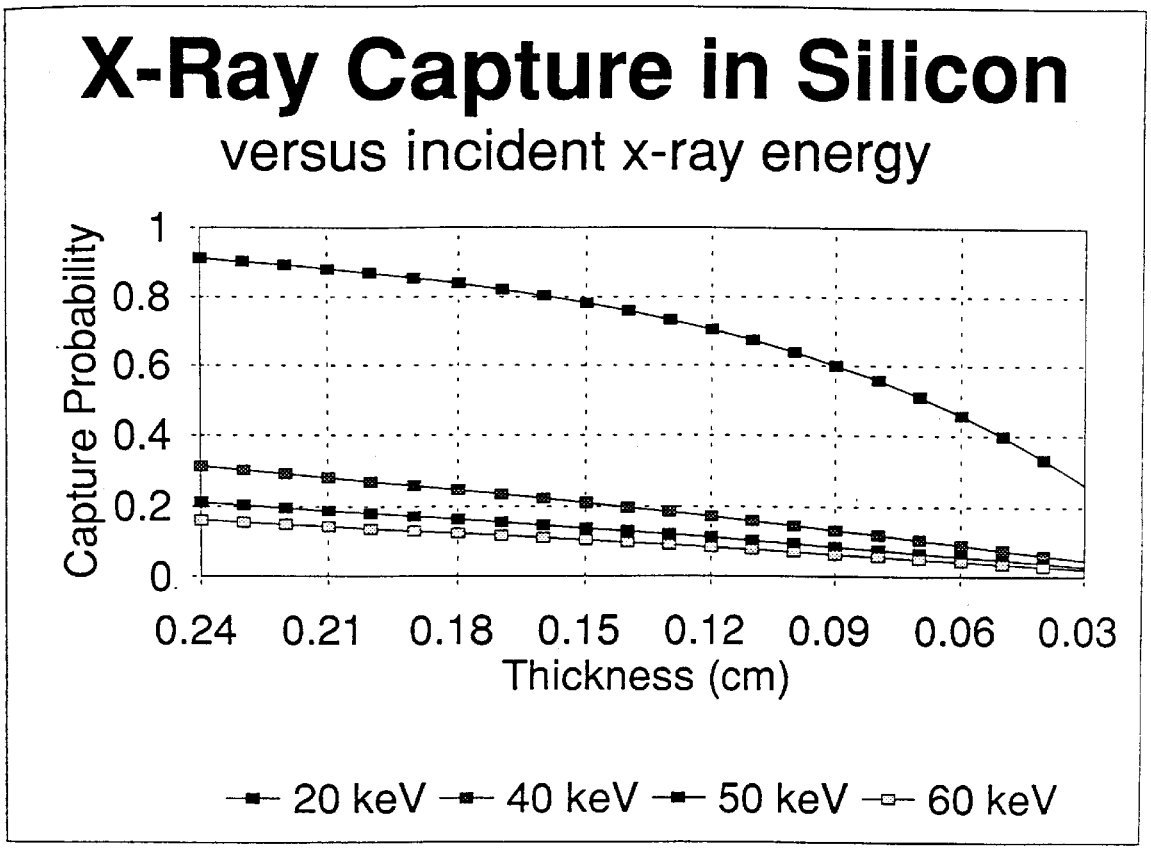
FIG. 6 graphically presents the efficiency for photon detection in relation to the thickness of a Si detector.

The detector is a two-dimensional detector {such as those described in Krummenacher, F., et al., *Nucl. Instruments & Methods Phy. Res.*, A288: 176–179 (1990)} and is preferably made from semiconductor materials suitable for the desired energy of the x-rays based on analysis such as shown in FIGS. 6 and 2. The two-dimensional detector can be an array of passive detecting elements or it can include a substantial amount of signal processing circuitry. In the latter, the two-dimensional detector incorporates information processing functions so that event selection or pattern recognition is actually integrated. The preferred two-dimensional detector is a double-sided crossed-strip detector. The more preferred two-dimensional detector is a detector constructed with individual pixels located on one side.

However, uncharged particles such as x- and γ-rays cannot be detected with a pair of single-sided crossed-strip detectors. The detection mechanism, either Compton scattering or the photoelectric effect, coupled with the very short range of the recoil electron restricts these neutral particles to a single crossed-strip detector. For example, an x-ray photon interacts with the electron of an atom in either the photoelectric or Compton effect. This electron will stop in a very short distance (27 $\mu$m for 20 keV and 180 $\mu$m at 60 keV). It is completely swallowed up by one piece of Si. Further, many applications require a bare minimum of material placed in the paths of particles. This makes it necessary to use double-sided crossed-strip detectors. These detectors have strips on one side to measure the x position and perpendicular strips on the other side to measure y. A pixel is then created by a coincident measurement of the x and y coordinates of a given hit. A double-sided crossed-strip detector with strips of n-type material embedded on one face and perpendicular strips of p-type material on the opposite face allow particle detection with a lesser amount of semiconductor, e.g., with 300 μm of Si along the particle's path rather than the 600 μm of two detectors.

The preferred crossed-strip detector is a crossed-strip Si detector such as: a double-sided microstrips Si detector {Alfano, B., et al., *Phys. Med. Biol.*, 37(5):1167–1170 (1992)}, a Si microstrip vertex detector {Antinori, F. et al., *Nuclear Instruments & Methods in Phy. Res.*, A288:82–86 (1990)}, Si tracker and preshower (SITP) detector {Munday, D., et al., *Nuclear Instruments & Methods in Phy. Res.*, A326:100–111 (1993); Borer, K., et al., *Nuclear Instruments & Methods in Phy. Res.*, A344:185–193 (1994)}, and modified Si UA2 detector {Ansari, R., et al., *Nuclear Instruments & Methods in Phy. Res.*, A279:388–395 (1989) and A288:240–244 (1990)}.

The more preferred detectors are constructed with individual pixels located on one side, examples of which are: a Si-pad detector {Ansari, R., et al., *Nuclear Instruments & Methods in Phy. Res.*, A288:240–244 (1990)}, Si pixel detector {Campbell, M., et al., *Nuclear Instruments & Methods in Phy. Res.*, A290:149–157 (1990); Delpierre, P., et al., *Nuclear Instruments & Methods in Phy. Res.*, A315:133–138 (1992)}, and OMEGA-ION pixel detector {Beker, H., et al., *Nuclear Instruments & Methods in Phy. Res.*, A332:188–201 (1993); Campbell, M., et al., *Nuclear Instruments & Methods in Phy. Res.*, A342:529–58 (1994)}. A full array of pixels as found in a conventional detector need not be used. The present invention presents a detector without a full array of pixels but with sparsely distributed pixels in which the pixels are strategically located on the detector screen to detect the radiation to produce an acceptable image. For example, every other pixel on a conventional detector screen may be left out without reducing the accuracy of the image. This is due to the fact that the radiation is raster scanned. However, correspondingly, the detection rate is reduced by 4 (i.e., $2^2$) due to fewer number of pixels. The advantage lies in the reduction of electronic channels by a factor of 4, which constitutes a big savings in materials, constructions, and costs. Preferably, one pixel is used for each 5 or less pixels found in a conventional full array of pixels. Where one pixel is used instead of 5, there is a reduction of detection rate by a factor of 25 but with a corresponding reduction of electronic channels and the savings accruing thereto. However, the savings are offset by the reduction in sensitivity, longer exposure time, and increased radiation to the patient. For applications which do not require high detection rate and/or in which increased radiation is acceptable, the pixel number can be further reduced. For each application, the optimal pixel number may be determined experimentally.

Si is the most common and widely used semiconductor material and its technology is well developed. The use of Si strip detectors in high-energy physics experiments is now about 20 old. They were originally used to define the spatial positions of charged particles in regions of fairly low radiation {see e.g., Ansari, R., et al., *Nuclear Instruments & Methods in Phy. Res.*, A279:388–395 (1989)}. Using diodes made with n-type Si implanted as strips laid down in Si crystalline material, resolutions of the order of 20 μm are common. This is better than all other methods of localization except emulsions, which do not allow electronic readout.

These detectors are used at high-energy accelerators throughout the world. They are typically made with Si of a thickness of 300 μm. Used with charged particles, typically two such detectors are used, with strips set perpendicular to one another to allow readout of both x- and y-coordinates. Detectors of 300 μm thickness produce about 25,000 electron-hole pairs from the passage of a minimum-ionizing particle (about 120 keV deposited). The development of annealing and other radiation hardening processes have brought these detectors into ever more common usage, as they allow for higher radiation doses to the Si before serious damage occurs.

Figure 5:
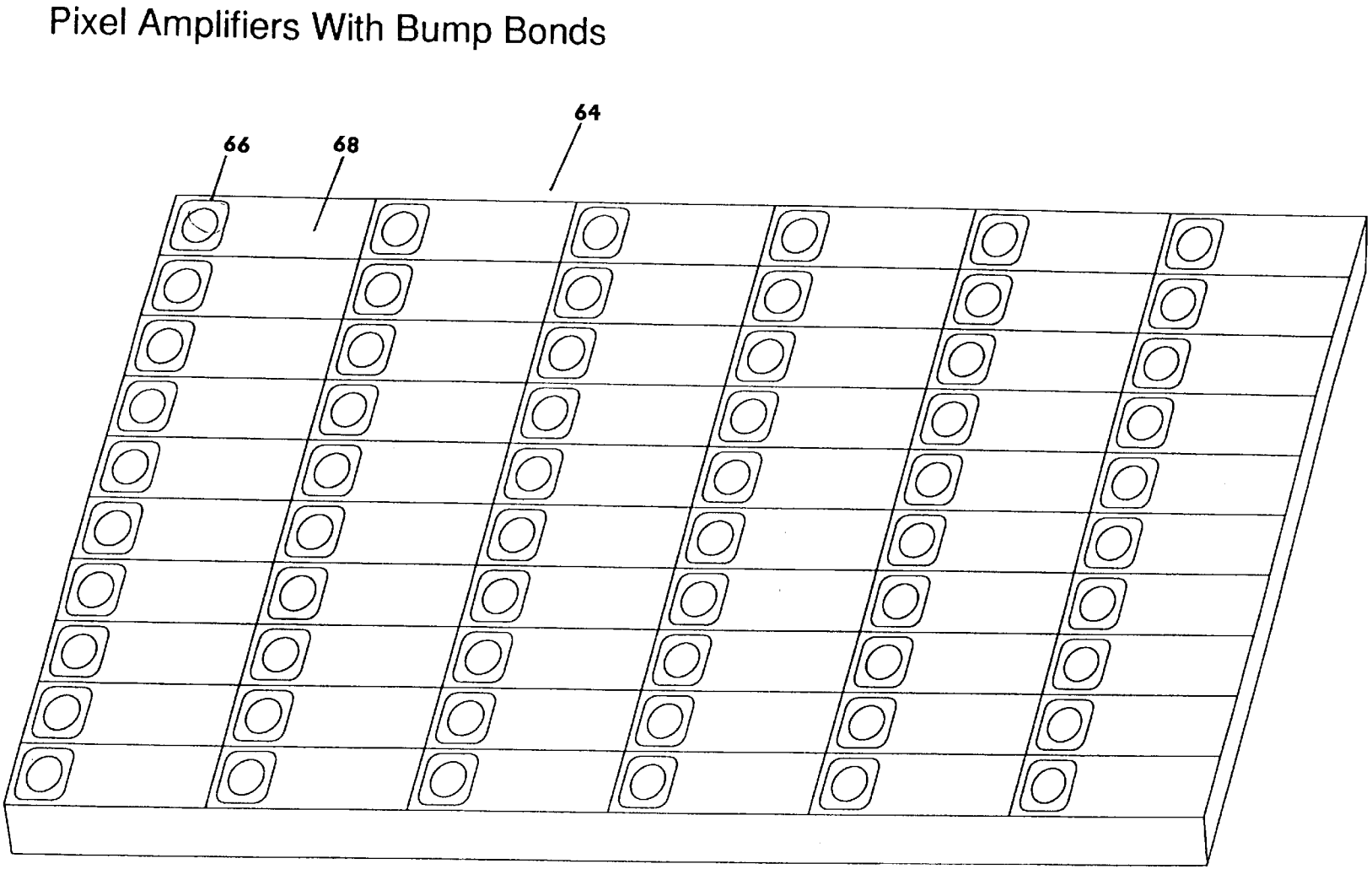
FIG. 5 schematically presents the pixel amplifiers on an array of a double-sided detector.

A detector constructed with individual pixels located on one side can be used in place of a crossed-strip detector. A crossed-strip detector has 2n individual channels, where n represents the pixel number. In contrast, a pixel detector constructed with individual pixels located on one side has $n^2$ individual channels. For example, in a mammography, a 10 $cm^2$ metallized anode could face the incoming x-ray beam while pixels of 0.5 $mm^2$ on 10 $cm^2$ (200×200) detector screen could be on the opposite face. Behind this could be an array of 40,000 Si low-noise amplifiers, each connected to the relevant pixel amplifiers 68 by an indium bump bonding technique (such as shown in FIG. 5). FIG. 5 schematically presents pixel amplifiers 68 on a pixel amplifier board 64 with indium bump bond 66 which connects the pixel amplifiers 68 with the individual pixels.

A comparable crossed-strip detector would have 400 channels of pixels or low-noise amplifiers. The advantage of MASS lies in the increased x-ray fluence that each pixel can handle, 1/200th of the rate handled by each strip. The disadvantage is the use of 40,000 channels replacing 400. Either technique is within the easy reach of modern technology and the one used depends in the end on the resolution, contrast, and the x-ray fluence desired. Pixel detectors are usually preferred. The crossed-strip or pixel detector of the desired characteristics may be routinely and experimentally determined using methods known in the art, such as described in e.g., Krummenacher, F. et al., *Nucl. Instruments & Methods Phy. Res.*, A288:176–179 (1990) and Campbell, M. et al., *Nuclear Inst. & Methods in Phy. Res.*, A290:149–157 (1990) for the crossed-strip detectors and Heijne, E. H. M., et al., *Nuclear Inst. & Methods in Phy. Res.*, A275:467–471 (1989) for the pixel detectors, modified by having the detector placed in the MASS configuration.

The information from the detector elements can be in the form of analog signals generated by individual particles or photons, or alternatively, it can be the total amount of charge integrated in an element during a time interval. In both cases, the signals could be processed through analog-to-digital conversion or through a discriminator (threshold comparison or 1-bit ADC) {Heijne, E. H. M., et al., *Nuclear Instruments & Methods in Phy. Res.*, A275:467–471 (1989)}. Alternatively, other forms of readout known in the art may be used. For example, the pixel detector may be read out by its individual amplifiers or by charge coupled device (CCD). The semiconductor detector is preferably used because it provides a direct link to digital information processing.

In the present invention, the size of the pixels (0.5 $mm^2$) is very large compared to modern standards, allowing new and innovative approaches to the electronic readout. Using a detector of 10 cm on a side with a strip pitch of 0.5 mm gives 200 strips per side. A double-sided detector thus has 400 channels of readout electronics (or 2n, where n=the number of strips). Since the readout amplifier is also Si based, the necessary transistors may be grown directly along the edge of each face, allowing a great reduction in capacitance and noise generation.

In the present invention, the x-ray emission spot can be moved in increments of a few micrometers at a time and a very high-resolution image of the region of interest (ROI) can be computed from the multiple lower resolution x-ray shadowgraphs. Resolution of the source object is determined by the convolution of the spatial frequencies of both the x-ray sources and the detectors. Thus, it is not necessary to make a detector with a huge number of pixels. High spatial frequencies at the x-ray source permits high resolution of the object being imaged. X-rays emitted by the target will be collimated to reduce unnecessary radiation to areas of the body other than to the ROI. The use of Si allows the detection electronics and the readout electronics to be grown on the same Si wafer.

The count rate per pixel is now much reduced. In addition, the moving source allows the strips to be spread out thereby lessening the number of channels of electronics needed. If there are N pixels excited on the x-ray tube, and M pixels in the detector array, there will be N×M, (i.e., N times M) pieces of data (say, 16-bits each).

A simple scaler system can be constructed in a system such as FASTBUS (a 10 MHz system) (commercially available, e.g., from LeCroy Corp.) or as a faster custom-made system. In modern Si electronics, a package of amplifier, discriminator, and scaler could be constructed and indium bump bonded to each pixel. A computer workstation can be used to store the information generated by each pixel of the detector. For example a detector with 200×200 detector pixels can be used, in combination with an x-ray source which generates 22500 source pixels (150×150) excited on the x-ray tube, the total digital output (which is the multiplication of 200×200×22500 pixels) results in 900 million locations on the scanned object, which is an enormous amount of detailed information which can be stored and processed by the computer workstation. In the case of a crossed-strip detector, there are only 200×2 detector signals, which when multiplied by the 22500 source pixels, produce a total of 9 million locations on the scanned object.

The reconstruction of images from this large amount of digital information is a straightforward task using Radon and Gilbert transformations. The detector array values for each point in the x-ray source raster are retrieved and used to construct a tomographic image of the object. A tomographic image is reconstructed from the multiple low resolution image frames, each frame having a slightly different "perspective" projection of the object. The tomographic image results from there being more information for resolving structures in the plane transverse to the axis connecting the x-ray generator and the detector array. This implies that the transverse plane resolution will be higher than the axial plane resolution. The usual tradeoffs of x-ray fluence vs. spatial resolution will apply to this system. Notice that the final resolution can be much smaller than the pixel separation. This is a great advantage. Each point on the screen produces an image which is incomplete but the sum of these incomplete images yields, by simple and routine inversion techniques known in the art, a complete tomographic picture.

Though the system is described as tomographic, there is much more information available here than is available in a normal tomographic system. For example, the above 900 M data locations contain a complete three-dimensional reconstruction of the object in question. This is not a system of slices as provided by normal tomography. The complete picture can be considered as a 200×200 matrix, some 22500 levels deep. The data is then taken in a set of single row or single column slices to produce a set of tomographic slices. Thus, a computer-based scan of 200 tomographic slices is achieved to search for telltale markers requiring further investigation or requiring the full three-dimensional capability of the present system.

The specific variables for MASS depends on its object and applications. Generally, its electron beam is between about 10 to 90 keV. The electron beam spot has a spot size of between about 10 to 500, and preferably about 100 $\mu$m. The x-ray radiation has a raster scan of between about 100 to 2000, and preferably about 500 $\mu$m. The pixel size of the detector is between about 100 to 2000 $\mu$m. Preferably, the image has a resolution of between about 25 to 50 $\mu$m in all three dimensions throughout the object. For high energy radiation, a radiation of between about 40 to 200 keV may be used.

Having described the invention in general terms, the following describes the specific application of MASS in mammography and high energy radiation. They are meant to illustrate MASS and are not to be construed as limiting the scope of the invention. One skilled in the art can use and expand on the teaching herein, including the following detailed illustration, to apply to other applications of MASS, for example, to replace radiography.

MASS FOR MAMMOGRAPHY

Standard mammographic examination will be greatly facilitated by increased resolution, accuracy and the three-dimensional nature of the information provided by MASS. Two-dimensional pictures can be misleading if there are several small calcium deposits located along the direction of a given x-ray. These will look, in projection, as if they were all located in a small volume. At present this finding requires several new radiation exposures at various angles. Three-dimensional MASS analysis allows the examining radiologist to determine if the deposits represent a health threat.

The standard mammography x-ray unit uses a Mo target and a Mo filter. This combination yields primarily the two x-ray lines at 17 and 19 keV. These are very soft x-rays. At these energies, in Si, the electrons are produced by the photoelectric effect rather than by Compton scattering. Thus they have the full energy of the x-ray. This is a decided advantage and will eventually allow (provided the measurement of energy is made accurate enough) separation of the unscattered from the scattered electrons.

The x-rays to be used in the present invention are primarily those at the 17 and 19 keV energies. The target material is Mo and the incident electron beam is approximately 25 keV. The full energy of the scattered electron is contained within a very small volume. It is known that a minimum-ionizing particle (MIP) deposits about 115 keV in passing through a detector of 300 $\mu$m thickness. This particle creates about 26000 electron-hole pairs, yielding a value of 4.5 eV/e-h pair ("e-h" is hereinafter used to denote electron hole). A 19 keV photon thus provides about 4200 e-h pairs. This is a small number by standards of this detection technique. Yet it is known in various charge coupled device (CCD) technologies that systems involving pre-amplifiers with noise levels of less than 100 electrons are not uncommon. Thus, a signal of the present invention should be readily detectable.

In the preferred embodiment of the invention, the MASS is constructed wherein a raster-scanned electron beam strikes a Mo screen of approximately 2 to 5 $\mu$m thickness. Present television or TV monitor technology allows a sweep of 150 mm×150 mm pixels in 0.5 seconds. With a reasonably high average beam current of 10 mA, the temperature rise of the screen will be approximately 1000° C. This significant temperature rise is well below the 2600° C. melting point of Mo. Should excess temperature become a problem, convection cooling or a thicker foil can be used. The temperature rise is inversely proportional to the thickness of the foil, so that a 5 μm thick foil will result in a temperature rise of 400° C. The electron beam will be scanned under direct computer control, for example, as shown in FIGS. 3(A) and (B) and discussed previously. As with standard mammography machines, a thicker Mo foil is used to intercept and re-emit the x-rays, thereby emphasizing the line structure as shown in FIG. 1 by the dotted curve.

Figure 4:
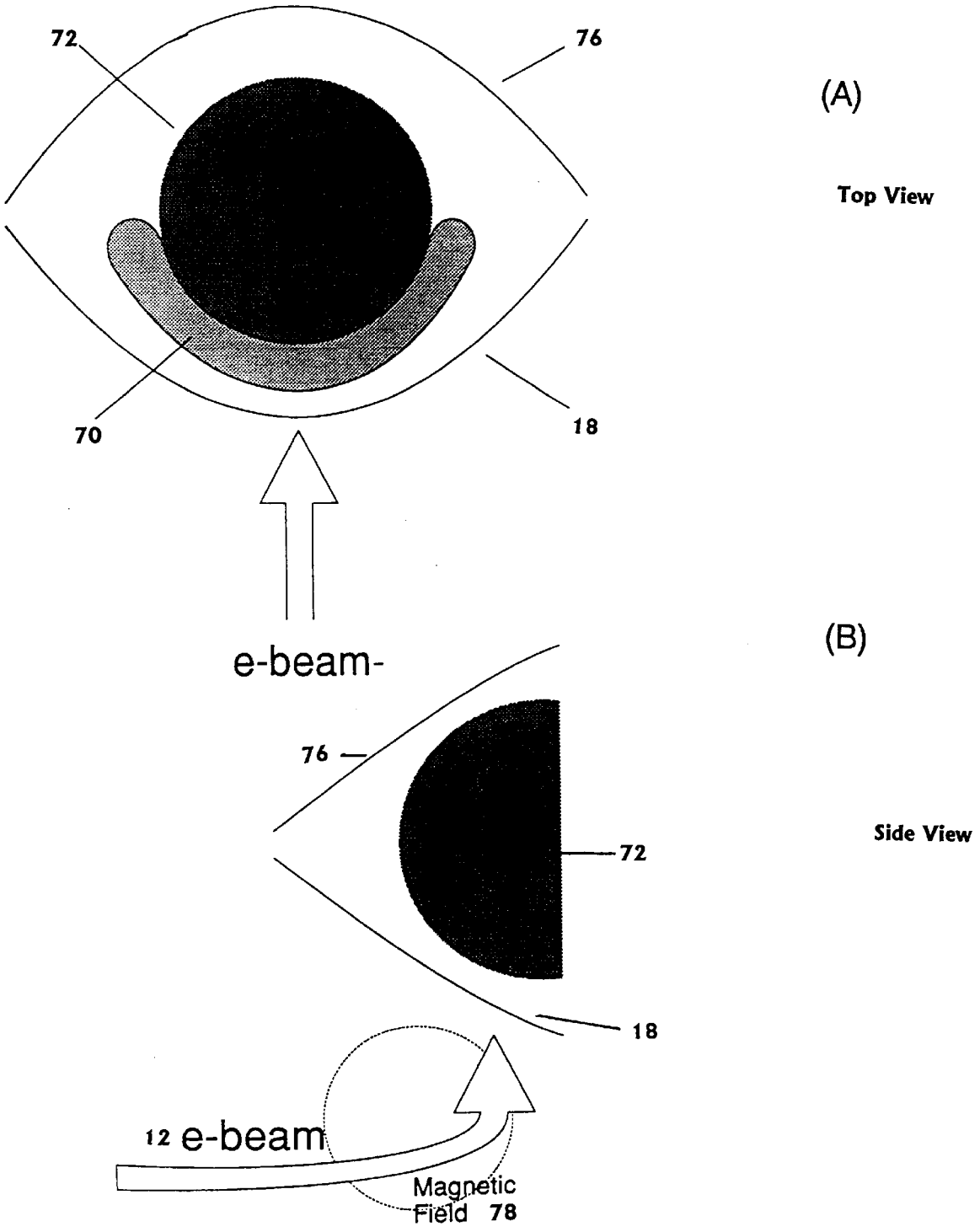
FIG. 4(A) presents a highly schematic top view of the mechanical holding system for the breast in mammography.
FIG. 4(B) presents a side view of a specific application of a mammography of the present invention.

An energy of 25 keV is sufficiently low so that moving the electrons becomes easy. For example, a magnetic field of 1000 gauss will bend the beam in a circle of about 5 mm. Bends of 90° can be made with small permanent magnets. Many possible geometries are possible (see e.g. FIGS. 4(A) and (B)). FIG. 4(A) presents the highly schematic top view of a mammography utilizing the present invention. The patient's breast 72 is held in place by the breast holder 70. FIG. 4(B) presents a side view of a specific application of a mammography of the present invention. The raster screen 18 is below the breast 72, the detector screen 76 is above the breast 72, the electron-beam 12 ("e-beam") is bent by a magnetic field 78 and directed towards the raster screen 18 below the breast 72. As configured in FIGS. 4(A) and (B), the system represents personal comfort advantages for the patient. In present mammography, the breast is compressed which is painful to many women. Therefore, though the standard compression fixture used in current commercial mammography may be used; in the preferred embodiment of this invention, the breast holder is anatomically shaped. Alternatively, light suction is used to hold the breast in place in a naturally shaped form. In one embodiment of the invention, the raster screen is below the breast and the detector screen is above the breast. Thus, the MASS apparatus previously described can be modified to include a mechanical holding system for the breast as shown in FIG. 4(A).

Alternatively, the final system may consist of several relatively small electron guns, each equipped with a Mo screen, each of which faces a small Si detector. This would allow the curved geometry shown in FIGS. 4(A) and (B) to be approximated by smaller, flat units. Thus, there are at least two ways to image an object in MASS. Using mammography as an example, the electron gun (with its Mo target) and the detector can be stationary. This arrangement is hereinafter referred to as "immobilized electron gun arrangement". The breast or its portion of interest is imaged as a whole in one raster scanning. Alternatively, one or more smaller electron guns (each with a Mo screen) or one electron gun (with a beam moved by magnets to scan several Mo screens) and their/its respective detector(s) can be moved alongside the breast section by section, and each section is separately raster scanned. Thus, this operation can be designed to resemble a CAT scan which scans and produces images of successive "slices" of the subject. However, in this arrangement, MASS is unlike a CAT scan in that it produces a complete three-dimensional reconstruction of the object, not just a series of slices provided by CAT scan. This arrangement is hereinafter referred to as a "moving electron gun arrangement".

In any of the above embodiments and for MASS in general, the detector screens may be planar or curved. In order to reduce geometrical parallax, the screen preferably conforms to or approximates the shape of the object or subject to be scanned. Alternatively, a curved detector may be made from several small planar pieces of detectors (and detector screens), and be used such as in place of the curved screen of FIGS. 4(A) and 4(B).

The preferred mammography uses a 10 cm×20 cm (for an immobilized electron gun arrangement) or 1 inch×1 inch (for a moving electron gun arrangement) Mo foil target of between 2 to 5 μm in thickness. The material and thickness of the target is selected to allow it to stop the electrons in order to emit the x-ray and yet allow the passage of the x-ray through the target. The electron gun system must be in a high vacuum. However, the thin Mo foil target conventionally used for mammography will not support such a vacuum. Thus, the present invention presents a wire mesh sufficient to support a Mo target of the desired thickness and shape. The wire mesh can be made of any material, and is preferably of stainless steel. Preferably, the wire mesh has mesh openings of approximately 100 μm and wires of about 150 μm. Upon this the Mo foil is placed. The openings supporting the Mo foil are preferably the size of the raster steps. The force on this smaller area is easily supportable. An overall thin support window of aluminum (as in present machines) or beryllium can be used as well for extra protection against implosion.

The step size for the electron beam can be chosen to maximize resolution. The preferred mammography also uses a step size of about 0.5 mm. The actual electron spot size is smaller, controlled by the ability to focus the beam itself. Present day computer monitors can detect at least 1024 pixels across the screen, so a beam spot size of 100 μm is a reasonable choice. Calculations using a raster scan of 500 μm and a detector pixel size of 500 μm gives a resolution of approximately 10 to 20 times better than the detector pixel size. Resolutions of 25 to 50 μm in all three dimensions throughout the object are expected.

Contrast (photon statistics) is of crucial importance in mammography. The x-ray fluence from each point on the Mo screen must be such that there are sufficient photons (e.g., 25 photons) detected from every voxel in the subject (i.e. three-dimensional pixel) of interest to establish an adequate gray scale. It is highly desirable to minimize the number of photons per voxel, subject to adequate counting statistics and noise considerations, so that the dose to the tissue is also minimized.

The only photons of real interest to the detector are those which are unscattered by the tissue through which they pass. Scattered photons contain no information of interest and damage the contrast of the image. Therefore, the Si detectors used preferably have energy selectivity and can be used to count only photons between 17 and 19 keV, to avoid detecting the scattered photons with energy less than the original.

Rate is also crucial for the electronic readout system. Normal x-rays are taken with exposure times of a few tenths of a second because of the need for the patient to be still. In the MASS apparatus (cf. FIGS. 4(A) and (B)), the breast is in a comfortable, body-shaped brassiere-cup holder, held in place by suction, controlled by the woman. This allows a longer x-ray exposure time, e.g. up to one second.

In the detector electronics, a very low noise rate is desired so that a signal of 4000 electron-hole pairs per converted photon will be easily seen. At these energies of between 17 to 19 KeV, in Si, the dominant absorption process is the photoelectric effect, therefore all of the x-ray energy is converted into electrical signal. All of the above effects combine to allow the lowest possible x-ray fluence, which is good news for the patient.

In summary, the most preferred x-ray mammogram set-up is as follows:

1. Raster step size of between 0.25 to 0.5 mm, with about 4000 step size per run;
2. For an immobilized electron gun, the raster screen is 10 to 20 cm on a side, with a wire mesh, e.g. a stainless steel wire mesh, with openings of about 1000 $\mu$m and wires of about 150 $\mu$m, upon which the Mo foil is placed. For a moving electron gun arrangement, the raster screen is between 1-inch square to 6-inch square, and the detector is of the corresponding size, i.e. a 1-inch square detector screen for a 1-inch square raster screen;
3. Between 15 to 25 keV and most preferably about 25 keV of electron gun in a vacuum;
4. Electron beam in raster scan, e.g., using a 12-bit digital to analog converter to produce 4096 (ie., $2^{12}$) steps across the raster screen. A 14-bit digital to analog converter will provide 16,000 steps, with smaller step size and providing better resolution in the image;
5. Beam spot size of less than about 100 $\mu$m;
6. Crossed-strip double-sided Si detector or the more preferred pixel detector with pixel size of approximately 0.5 mm or individual pixel detector of similar size. A step size of 0.5 mm and a pixel size of 0.5 mm, produces a resolution in the body/breast of less than 0.05 mm;
7. At least about 25 photons detected from every voxel;
8. Si detector which can be made to view only between 17 to 19 keV;
9. Short dwell time, e.g., dwell time of 25 $\mu$sec per pixel; and
10. Resolution of 25–50 $\mu$m in all three dimensions throughout the object; and
11. Readout electronics on individual pixel (or strip) basis or in standard CCD collection mode. CCD are commercially available, such as from Sony Corporation, Los Angeles, Calif.; and Photonics Corp., Tucson, Ariz.

The relationship between anode step size and pixel size will be determined experimentally. In the above arrangement, as a starting point, the ratio of the subject size to image size can be 1:1, corresponding to the ratio of anode step size to detector pixel size of 1:1 which is controlled by having the subject, anode, and detector, at equidistance from one another. The relationship of these sizes (i.e. anode step size and pixel size) to resolution in the body can be approximately calculated and confirmed by routine experimentation. The preferred range is between 25:1. In general, the resolution is best when the subject is midway between the detector and the anode. This does not have to be so in all instances. The detector or the anode can (and sometimes will) be in close proximity or in contact with the subject, such as shown in FIGS. 4(A) and 4(B) for the anode plate 18 and detector screen 76.

APPLICATION IN STANDARD RADIOGRAPHY

Figure 10:
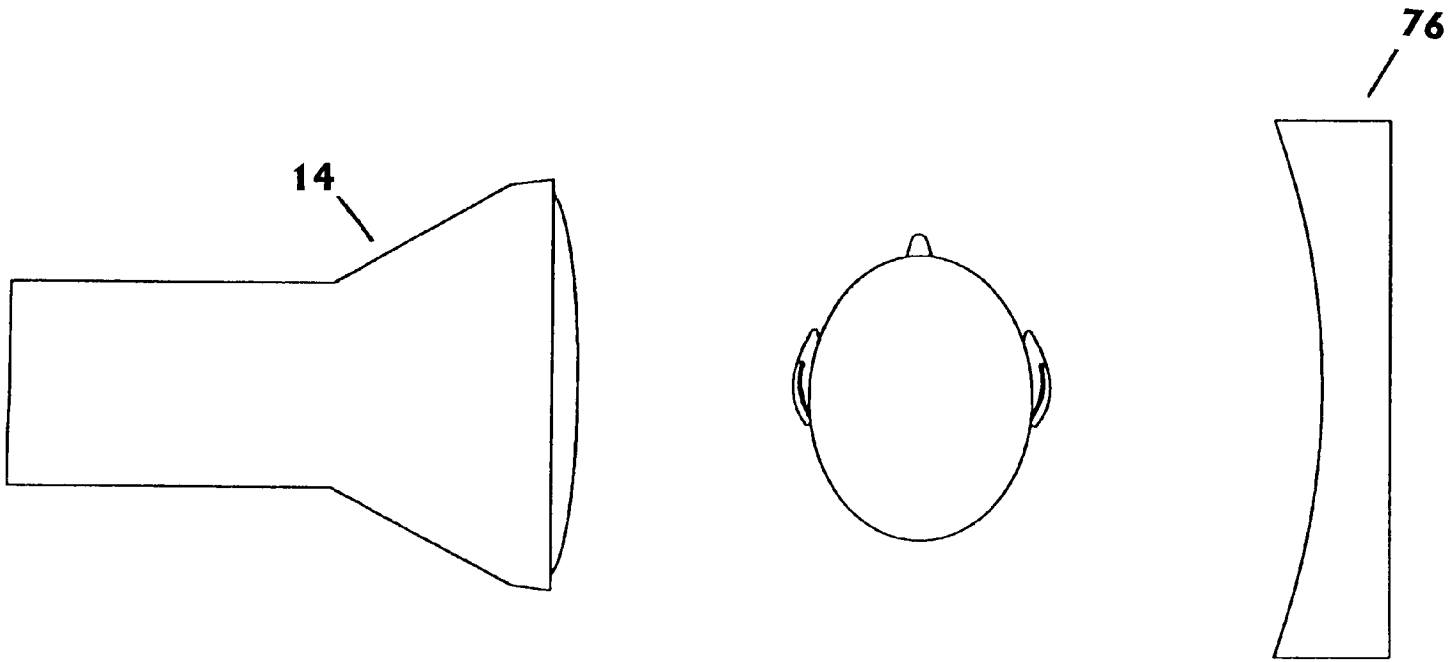
FIG. 10 schematically presents another application of the invention for three-dimensional imaging of a patient's head, such as his jaw.

For conventional radiography of body parts which are not soft tissues, such as a breast, a higher energy x-ray source of between about 40 to 90 keV is generally used. To do more standard radiographic images of bone and tissue, a higher energy x-ray source is required. There are also numerous other applications where higher energy photons can be used. The electron beam energy is determined based on the subject and application, and is generally known in the art. For example, generally, for skeleton or bone, an electron beam energy of up to about 60 keV is preferred for bone penetration. MASS, using higher energies, are optimal for dental and orthodontic procedures. For skull and jaw x-rays, an electron beam energy of up to about 100 keV, and preferably between about 80 to 100 keV is used (see FIG. 10). FIG. 10 schematically presents another application of the invention for three-dimensional imaging of a patient's head, such as his jaw and dental structure. Compared to present imaging techniques, MASS produces images with greater detail (<50 $\mu$m) and in three dimensions.

For non-destructive testing of metal (further described below), an electron beam energy of between about 100 to 200 keV is generally used.

When the energy of the electron beam increases to the order of 60 keV and above, the Mo screen is preferably replaced by a tungsten (W) screen (available from DigiRay Corp) which is thicker and stronger and can also better withstand the vacuum in the electron gun.

Generally, it is vital that the energy of the incoming photon be measured. Si can be used as the detector material for electron beam energy of less than or equal to 40 keV, or more preferably, for electron beam energy of less than or equal to 20 keV. For energies higher than about 50 keV, it will become increasingly difficult to use Si as the detector material (see FIG. 6 which graphically presents the efficiency for photon detection in relation to the thickness of a Si detector). As seen in FIG. 6, the efficiency for photon detection in Si is only about 10% even if the thickness of the detector is increased to about 1 mm. Thus, other suitable materials are to be used, based on their efficiencies for photon detection, such as the information contained in FIG. 2, which shows the efficiency for photon detection by CdTe, in relation to the energy of the incident x-ray and the thickness of CdTe. There is only about 10–20% Zn in ZnCdTe, therefore, the graph for ZnCdTe will be close to that of FIG. 2. A similar graph can be obtained for $HgI_2$ using information known in the art. Thus, examples of suitable detector materials are: $HgI_2$ (mercuric iodide), and Cd compounds such as $Zn_xCd_{1-x}Te$ (Zinc Cadmium Telluride, wherein $0 \leqq x \leqq 1$). $HgI_2$ and $Zn_xCd_{1-x}Te$ are good detector materials for electron beam energy of between 150–200 keV. A new detection technique is not necessary with a new detection material.

Figure 7:
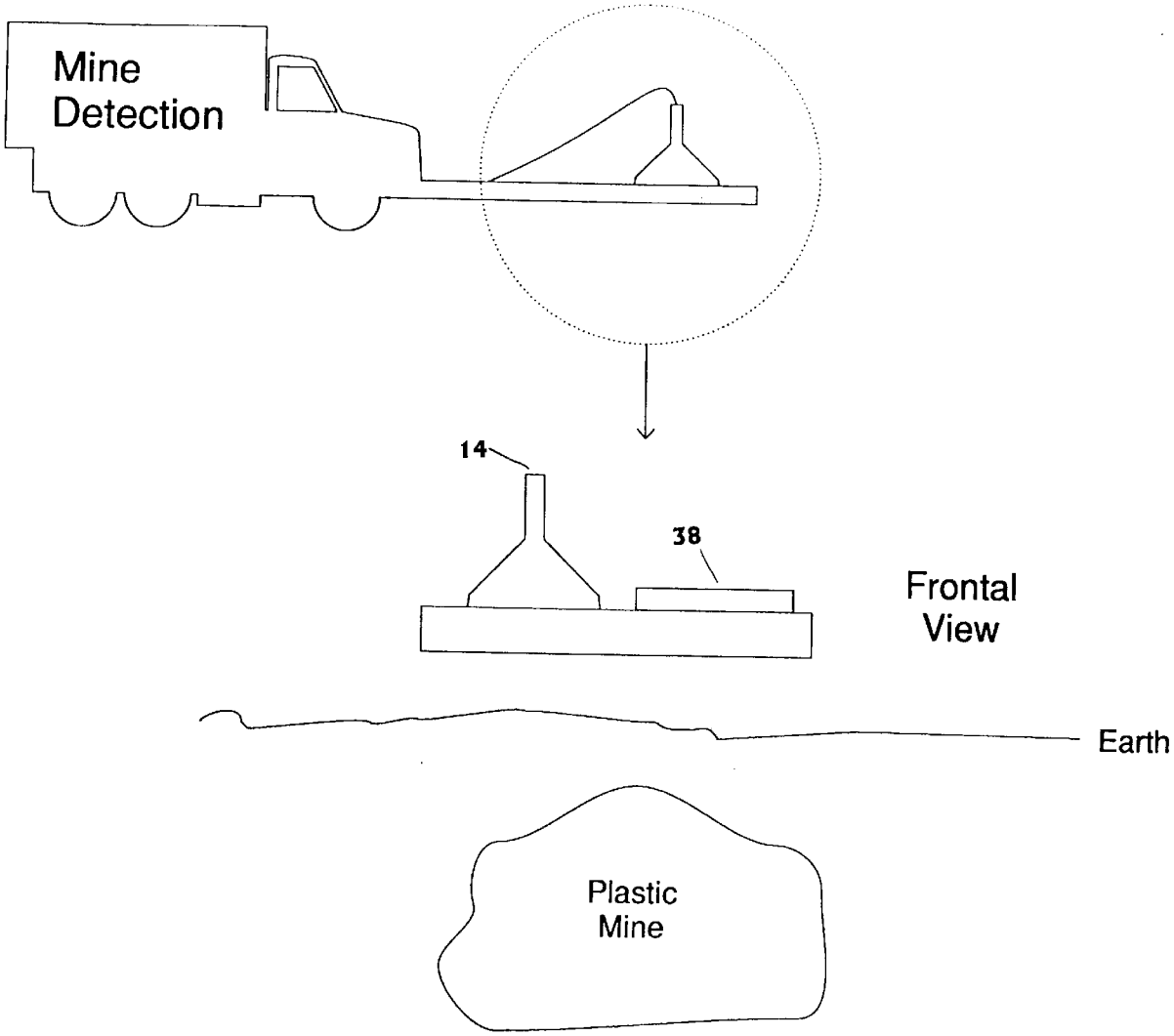
FIG. 7 schematically presents one application of the invention in mine detection.

Detectors with pixels (or stripes) of the order of 0.5 $mm^2$ can be made from dense materials such as $Zn_xCd_{1-x}Te$ or $HgI_2$ and are available in both experimental and commercial quantities. These have detection efficiencies on the order of >50% in standard available thicknesses. They both have large band gaps at room temperature and provide almost entirely photoelectric effect capture cross-sections. This means that all of the photon's energy will be captured and there will be approximately 12,000 electron-hole pairs. These two high-Z materials are used to pursue radiological goals at energies higher than mammography. The high-Z detectors, $Zn_xCd_{1-x}Te$ and $HgI_2$, work very well up to energies of approximately 200 keV. This makes them an attractive possibility for many forms of materials studies, and non-destructive testing that is currently performed using x-rays: such as non-destructive testing of metals, e.g. on welds, aircraft parts, and for metal fatigue crack detection. Additionally, the system can be used for airport luggage checking, and to detect non-metallic military mines by means of back-scattered x-rays. An illustration of the use of MASS for this application is shown in FIG. 7. FIG. 7 schematically presents one application of the invention in mine detection; using scanning x-ray source 14 and two-dimensional detector 38. In this case, the detector 38 detects the x-ray that has been reflected off (i.e., back-scattered x-rays) the mine and thereby image and locate the mine. Because of the high-Z nature of the detectors of the present invention, nearly all of the photons are converted to an electric signal via the photoelectric effect, thus they have the full energy of the photon. Specific energy measurements can be made by adding an ADC to the chain of electronics. By using several different photon energies, the digital nature of the MASS allows direct subtraction radiology to be done. Pictures without bones, for example, become possible.

The production of several different energy photons during the same exposure can be done in a straightforward manner by using several screen materials on the same surface. On standard television monitors, a matrix of different color pixels is created, all in close proximity to one another. Several electron guns are then often used to strike the different colored phosphors. This can also be done using pixels of different metals (or other elements) to generate x-ray photons of different energies. This system could be very similar to the supporting mesh and Mo foil of the present invention. In the present case, both metals could be struck by electrons to produce various energy x-rays.

All publications and patent applications mentioned in this Specification are herein incorporated by reference to the same extent as if each of them had been individually indicated to be incorporated by reference.

Although the foregoing invention has been described in some detail by way of illustration and example for purposes of clarity and understanding, it will be obvious that various modifications and changes which are within the skill of those skilled in the art are considered to fall within the scope of the appended claims. The examples are presented to illustrate some aspects of the invention, and are not to be construed as limiting the scope of the invention. Future technological advancements which allows for obvious changes in the basic invention herein are also within the claims.

We claim:

1. An imaging apparatus for examining an object to display a three dimensional image of voxels of a material of interest within said object, comprising:

a radiation generating source including means for directing radiation in a raster from said source to said object, said radiation being capable of penetrating said object but being impeded by said material of interest;

a two-dimensional detector capable of detecting said radiation that passes through said object whereby to determine the impedance of said radiation by said material of interest and generating said image, said detector comprising an array of radiation detecting members, the x and y position of each member of said array corresponding to the x and y position of the detected raster generated radiation; and means for moving said radiation or radiation source alongside said object with said two-dimensional detector moving correspondingly alongside the opposite side of said object to detect said radiation which passes through said object.

2. An imaging apparatus for examining a breast of a human to display a three dimensional image of voxels of a cellular or structural component within said breast, comprising:

a radiation generating source including means for directing radiation in a raster from said source to said breast, said radiation being capable of penetrating said breast but being impeded by said material of interest; and a two-dimensional detector capable of detecting said radiation that passes through said breast whereby to determine the impedance of said radiation by said cellular or structural component and generating said image, said detector comprising an array of radiation detecting members movable to scan sequential sections of said breast, the x and y position of each member of said array corresponding to the x and y position of the detected raster generated radiation.

3. An imaging apparatus for examining an object to detect the presence of a material of interest within said object, comprising:

a radiation source including means for directing radiation in a raster from said source to said object, said radiation being capable of penetrating said object but being impeded by said material of interest; and a two-dimensional detector capable of detecting said radiation whereby to determine the impedance of said radiation by said material of interest, said impedance being determined by said two-dimensional detector detecting the radiation that reflects from the object.

4. The imaging apparatus of claim 3, wherein said radiation or radiation source is moved alongside the object, with the two-dimensional detector moving correspondingly along the same side of the object to detect the radiation that reflects from the object.

5. A method for examining an object to detect the presence of a material of interest within said object, comprising:

generated from a radiation source directing radiation in a raster from said source to said object, said radiation being capable of penetrating said object but being impeded by said material of interest; and disposing a two-dimensional detector capable of detecting said radiation whereby to determine the impedance of said radiation by said material of interest, wherein said impedance is determined by said two-dimensional detector detecting the radiation that reflects from the object.

6. An imaging apparatus for examining the breast of a human to display a three dimensional image of voxels of an abnormal cellular component within said breast, comprising:

a radiation generating source including means for directing radiation in a raster from said source to said breast, said radiation being capable of penetrating said breast but being impeded by said material of interest; and a two-dimensional detector capable of detecting said radiation that passes through said breast whereby to determine the impedance of said radiation by said abnormal cellular component and generating said image, said detector having a non-linear shape for receiving said breast whereby to facilitate close fitting to said breast and comprising an array of radiation detecting members, the x and y position of each member of said array corresponding to the x and y position of the detected raster generated radiation.

7. The imaging apparatus of claim 6, further comprising means for converting the detection by the two-dimensional detector into digital output.

8. The imaging apparatus of claim 6, in which said detector has a curvilinear shape.

9. The imaging apparatus of claim 6, further comprising means for generating said image based on the detection by the two-dimensional detector, wherein said image is a three-dimensional image.

10. The imaging apparatus of claim 9, further comprising means for converting the detection by the two-dimensional detector into digital output.

11. The imaging apparatus of claim 9, wherein the two-dimensional detector is a cross-stripped or pixel detector.

12. The imaging apparatus of claim 11, wherein said radiation is directed upward from below the breast and said two-dimensional detector is above the breast to receive any radiation which passes through the breast.

13. The imaging apparatus of claim 11, wherein said breast is held by suction or an anatomically shaped breast holder.

* * * * *